United States Patent [19]

Rudick

[11] Patent Number: 4,826,046

[45] Date of Patent: May 2, 1989

[54] MULTI-CHANNEL LINEAR CONCENTRATE PUMP

[75] Inventor: Arthur G. Rudick, Marietta, Ga.

[73] Assignee: The Coca-Cola Company, Atlanta, Ga.

[21] Appl. No.: 60,336

[22] Filed: Jun. 10, 1987

Related U.S. Application Data

[63] Continuation-in-part of Ser. No. 24,477, Mar. 11, 1987, Pat. No. 4,753,370, which is a continuation-in-part of Ser. No. 842,287, Mar. 21, 1986, Pat. No. 4,708,266.

[51] Int. Cl.[4] ..... B67D 5/56

[52] U.S. Cl. ..... 222/129.3; 222/133; 222/145; 417/538; 92/33

[58] Field of Search ..... 417/538, 521; 92/33; 222/145, 129.1, 129.3, 129.4, 132, 133, 135, 136, 137, 318, 275, 276

[56] References Cited

U.S. PATENT DOCUMENTS

| | | | |
|---|---|---|---|
| 131,952 | 10/1972 | Henderson . | |
| 625,291 | 5/1899 | Dean . | |
| 664,230 | 12/1900 | Salyer | 417/538 |
| 1,103,569 | 7/1914 | Davidson | 417/538 |
| 1,548,981 | 8/1925 | Clark | 417/538 |
| 2,093,344 | 9/1937 | Wandel . | |
| 2,427,429 | 9/1947 | Waite et al. | 222/129.3 |
| 2,679,208 | 5/1954 | Euverard . | |
| 3,388,603 | 6/1968 | Clark | 92/33 |
| 3,672,389 | 6/1972 | McConnell et al. . | |
| 3,771,918 | 11/1973 | Winter | 417/266 |
| 3,814,289 | 6/1974 | Robbins | 222/135 |
| 3,816,029 | 6/1974 | Bowen et al. . | |
| 3,871,268 | 3/1975 | Misima | 417/429 |
| 4,556,367 | 12/1985 | Schmid . | |
| 4,708,266 | 11/1987 | Rudick | 222/135 |

FOREIGN PATENT DOCUMENTS

| | | | |
|---|---|---|---|
| 3039255 | 7/1982 | Fed. Rep. of Germany | 92/33 |

*Primary Examiner*—H. Grant Skaggs

*Attorney, Agent, or Firm*—Birch, Stewart, Kolasch & Birch

[57] ABSTRACT

A concentrate supply assembly for a post-mix beverage dispenser includes a plurality of containers for concentrate with discharge openings through which concentrate may flow. A plurality of conduits are coupled to the discharge openings and are in fluid communication with concentrate disposed within the containers. A multi-channel linear pump is provided with a pump body or bodies, including bores disposed within the pump bodies, pistons operatively mounted within the bores for reciprocation and piston shafts connected to the pistons. An A.C. synchronous motor is connected to the piston shafts for imparting constant-speed reciprocal motion to the piston shafts and to the pistons disposed within the bores. Inlet ports are in fluid communication with the conduits and bores for supplying concentrate thereto during a reciprocal motion of the pistons in a first direction. Outlet ports are in fluid communication with the bores for discharging concentrate from the bores during a reciprocal motion of the pistons in a reverse direction. A ball joint connection is provided between the piston shafts and the motor for enabling accurate positioning of the piston connected to the piston shaft within the bore.

5 Claims, 16 Drawing Sheets

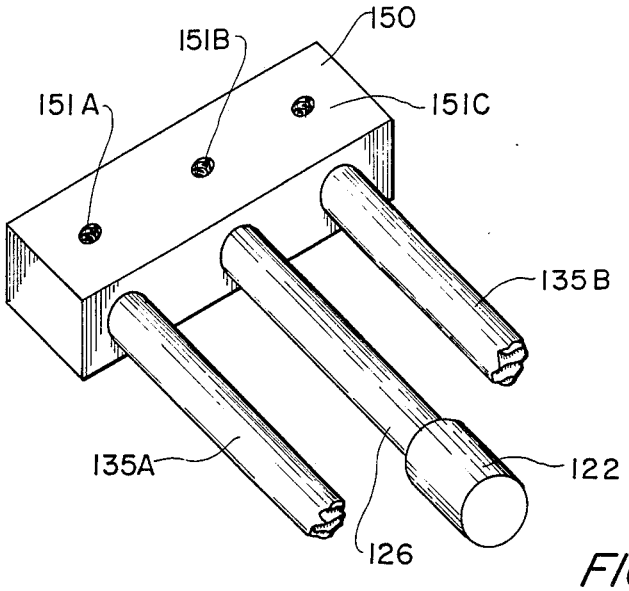
FIG. 3
PRIOR ART
FIG. 4(b)
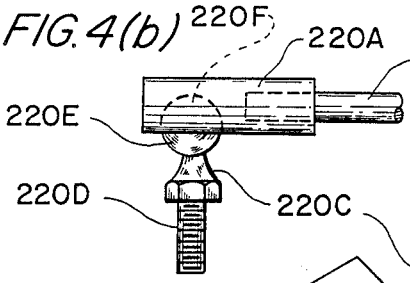
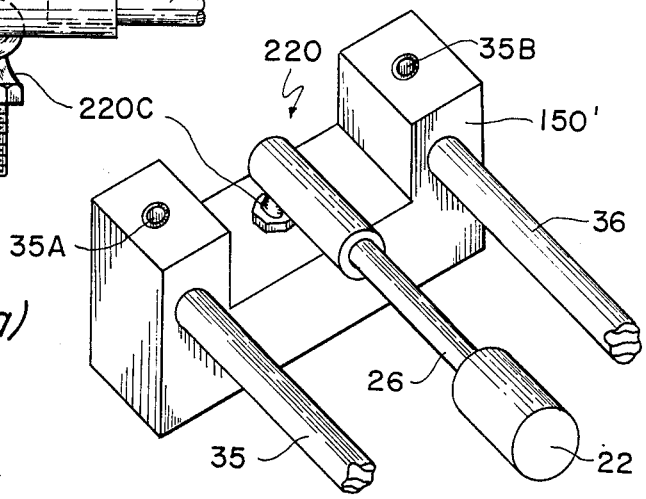
FIG. 4(a)

MULTI-CHANNEL LINEAR CONCENTRATE PUMP

CROSS-REFERENCE TO RELATED APPLICATIONS

The present application is a Continuation-in-Part of copending application Ser. No. 024,477, filed Mar. 11, 1987 to Rudick and now U.S. Pat. No. 4,753,370, which in turn is a continuation-in-part of copending application Ser. No. 842,287, filed Mar. 21, 1986, also to Rudick and now U.S. Pat. No. 4,708,266. All three applications are assigned to the same assignee.

BACKGROUND OF THE INVENTION

The present invention relates to a concentrate supply system for a post-mix beverage dispenser. More specifically, the present invention relates to a concentrate dispensing system including a multi-channel linear pump for dispensing one of a plurality of concentrates to a mixing nozzle in metered quantities.

In the aforementioned applications of which this application is a continuation-in-part, the concentrate supply assembly is disposable and isolated from the remaining portions of the post-mix beverage dispensing system. This disposable assembly of concentrate containers and supply tubes is operatively connected to a plural channel peristaltic pump which supplies accurate metered quantities of concentrate to a mixing nozzle. Although the use of a peristaltic pump is quite satisfactory, it would be desirable to provide an alternative form of multi-channel pump for pumping accurate metered quantities of syrup in these systems.

One form of pump which could be used is a double-acting, piston-type linear pump driven by an A.C. synchronous motor. Since the synchronous motor is driven at a constant speed, accurate, metered quantities of concentrate could be pumped by turning the pump on and off at selected times, since the concentrate flow rate would be constant during the on times of the pump.

Although linear pumps driven by A.C. synchronous motors are known, a need in the art exists for such a pump which is adaptable for use as one channel of a multi-channel linear pump in the post-mix beverage systems, such as in the aforementioned Rudick applications. Furthermore, a need in the art exists for a suitable manner for mounting a plurality of linear pumps side-by-side for use as a multi-channel linear pump between the concentrate supply and dispensing nozzle of a post-mix beverage dispensing system.

SUMMARY OF THE INVENTION

It is an object of the present invention to provide a multi-channel linear concentrate pump wherein concentrate may be selectively pumped in metered quantities from a container to a mixing nozzle in a post-mix beverage dispenser.

Another object of the present invention is to provide a multi-channel linear concentrate pump which utilizes A.C. synchronous motors for imparting reciprocating motion to double-acting piston assemblies in the multi-channel linear concentrate pump.

It is a further object of the present invention to provide a compact mounting assembly for supporting a plurality of linear pumps side-by-side to create a multi-channel linear pump suitable for use in a post-mix beverage dispensing system.

It is yet another object of the present invention to provide a valving system for a multi-channel linear pump to facilitate selective discharge from the respective channels of the pump to the mixing nozzle of the dispenser.

It is still a further object of the present invention to provide a self-centering drive assembly for the pistons of a multi-channel linear pump.

These and other objects of the present invention are achieved by providing a concentrate supply system for transporting concentrate to the mixing nozzle of a post-mix beverage dispenser comprising:

(a) plurality of containers for concentrate having discharge openings through which concentrate may flow;

(b) a corresponding plurality of double-acting linear pumps, one linear pump being operatively associated with each of said containers by having an inlet thereof in fluid communication with the discharge opening of the associated container;

(c) A.C. synchronous motor means for driving each respective linear pump to pump concentrate from said containers through the pump at a constant rate of flow;

(d) a three-way valve connected to an outlet of each linear pump, said three-way valve having a first position in which concentrate from the associated outlet passes therethrough to said mixing nozzle and a second position in which said concentrate is recirculated to the inlet of the associated pump; and (e) selector means for placing a selected one of said three-way valve means in said first position and the other of said three-way valves in said second position, whereby a selected one of the concentrates in the container associated with the three-way valve in said first position is pumped to said mixing nozzle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1(*b*) is a schematic view illustrating a first embodiment of a single pump channel of the multi-channel pump of the present invention utilizing a single motor and a three-way valve for dispensing concentrate from a concentrate module to a mixing nozzle;

FIG. 2(*b*) is a schematic view illustrating a plurality of single channel pump bodies disposed side-by-side to form the multi-channel linear concentrate pump of the present invention;

FIG. 3 is a partial perspective view illustrating an end connector and piston affixed thereto in a conventional manner for prior art linear pumps;

FIG. 4(*a*) is a partial perspective view illustrating a piston affixed to an end connector according to the improvements of the present invention;

FIG. 4(*b*) is a side view illustrating the ball joint according to the present invention;

DETAILED DESCRIPTION OF THE PREFERRED EMBODIMENTS

Figure 1A:
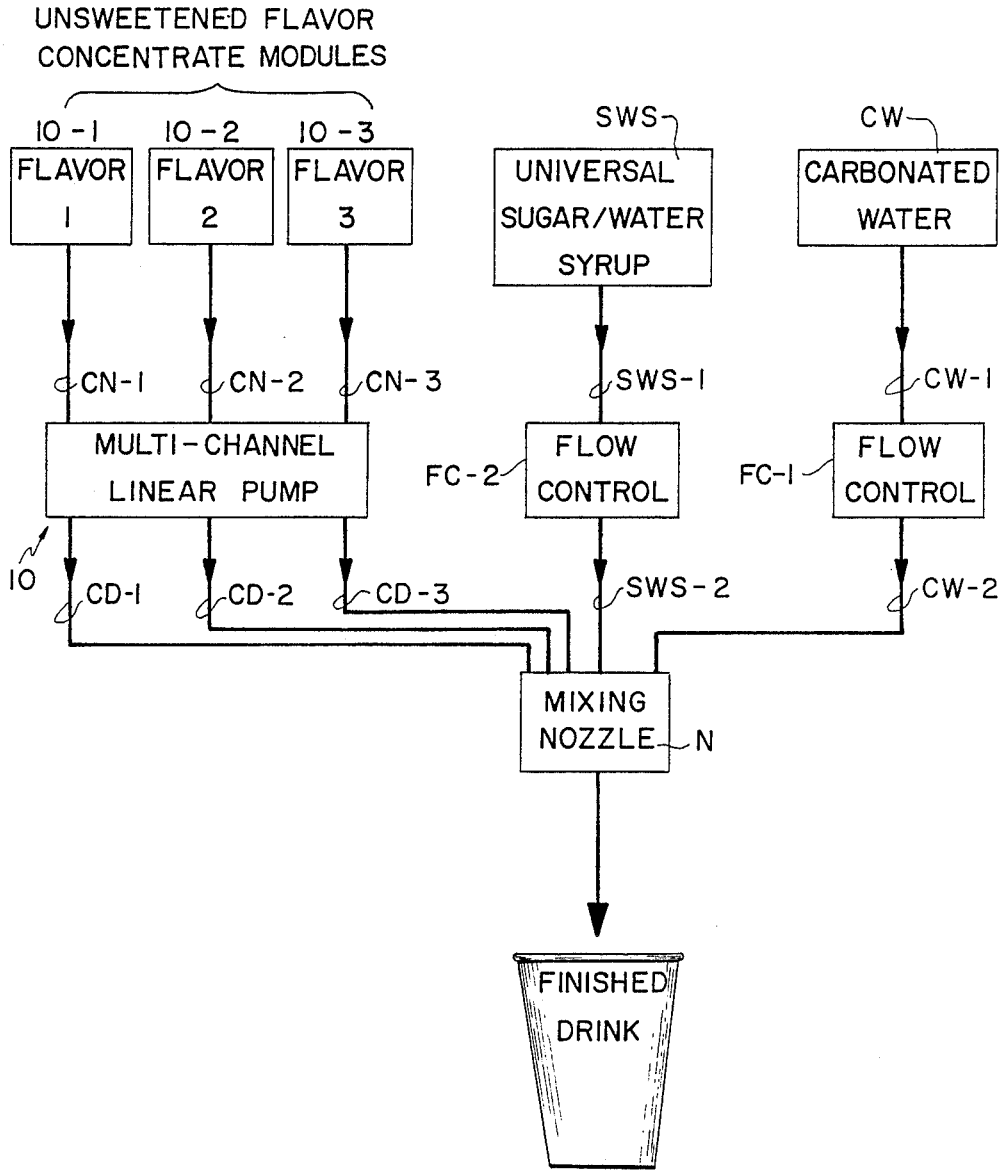
FIG. 1(*a*) is a schematic diagram illustrating an exemplary post-mix beverage dispensing system including concentrate modules, a universal source of sugar/water syrup and a source of carbonated water connected to the multi-channel linear concentrate pump of the present invention.

FIG. 1(*a*) illustrates a schematic view of the various post-mix beverage system components utilized in combination with the pump of the present invention. More specifically, unsweetened flavor concentrate modules 1013 1, 10—2, and 10—3 contain concentrate flavors 1, 2 and 3, respectively. Each one of the unsweetened flavor concentrate modules 10—1, 10—2, and 10—3 is connected by means of an individual tube CN-1, CN-2 and CN-3, respectively, to a multi-channel linear pump 10. A plurality of individual tubes CD-1, CD-2 and CD-3 are operatively connected via pump 10 to individual supply tubes CN-1, CN-2 and CN-3, respectively. Tubes CD-1, CD-2, and CD-3 are also coupled to a mixing nozzle N. A universal sugar/water syrup supply SWS is operatively connected by means of a tube SWS-1 to a flow controller FC-2. The flow controller is connected by means of a tube SWS-2 to a mixing nozzle N. In addition, a source of carbonated water CW is connected by means of a conduit CW-1 to a flow control valve FC1. The supply of carbonated water is connected by means of a tube CW-2 to the mixing nozzle N. In operation, an individual would select one of the flavors 1, 2 or 3. As one of the flavors is selected, the multi-channel linear pump 10 pumps unsweetened flavored concentrate at a predetermined rate from the preselected flavor concentrate modules 10—1, 10—2, and 10—3 through the multi-channel linear pump to one of the discharge conduits CD-1, CD-2 or CD-3. Simultaneously, the flow controllers FC2 and FC1 supply sugar/water syrup and carbonated water at a predetermined rate to the mixing nozzle N. The mixing nozzle N receives the selected concentrate flavor 1, 2, or 3, the sugar/water syrup and carbonated water simultaneously and directs the fluids to an isolated area outboard of the nozzle so that the concentrate never touches the nozzle walls in order to minimize the need for subsequent cleaning of the nozzle. The system can also be used for diet drinks. In that case the flavor concentrate inside the module contains an artificial sweetener. When the diet product is selected, only the artificially sweetened flavor concentrate and carbonated water in the proper proportions are allowed to flow to the mixing nozzle. Details of the system of FIG. 1 and the mixing nozzle are fully described in the copending application of Arthur G. Rudick, Ser. No. 024,477, filed Mar. 11, 1987 and entitled "Tri-Mix Sugar Based Dispensing System". However, the multi-channel linear pump 10 of the present invention has been substituted for the peristaltic pump of that system.

FIG. 1(*b*) illustrates a first embodiment of a multi-channel linear pump which may be utilized together with the system illustrated in FIG. 1(*a*). As illustrated in FIG. 1(*b*), the multi-channel linear concentrate pump 10 is provided including a first pump body 20 and a second pump body 21. A bore 24 is disposed within the pump body 20. Similarly, a bore 25 is disposed within the pump body 21. A piston 22 is reciprocatively mounted within the bore 24. The piston 22 is connected to a piston shaft 26. Similarly, a piston 23 is reciprocatively mounted within the bore 25. A piston shaft 27 is operatively connected to the piston 23.

A carriage 30 is mounted for reciprocation relative to the first pump body 20 and second pump body 21. The carriage 30 includes guide rods 35A, 35B. In addition, end connectors 50A, 50B are secured to respective ends of the guide rods 35A, 35B. The guide rod 35A is slidably mounted within a carriage guide block 36A. Similarly, the guide rod 35B is slidably mounted within a carriage guide block 36B.

A motor 40 is mounted centrally relative to the first pump body 20 and second pump body 21. A shaft 54 extends through the motor 40. Ball joint assemblies are utilized to secure the shaft 54 and the piston shafts 26, 27 to the end connectors 50A, 50B. Ball joint 28 secures the shaft 26 to the end connector 50A. Similarly, ball joint 32 secures one end of the shaft 54 to the end connector 50A. The other end of the shaft 54 and the piston rod 27 are secured to the end connector 50B by means of the ball joints 52 and 29, respectively. The ball joint assemblies ensure that the pistons 22 and 23 are accurately disposed within the bores 24, 25, respectively, as the motor 40 imparts reciprocation to the shaft 54 and thus reciprocates the carriage assembly 30 to impart reciprocation to the piston shafts 26, 27 and the pistons 22, 23.

A source of flavor concentrate 60 is connected by means of a conduit 62 to an inlet supply conduit 64. The inlet supply conduit 64 is connected by means of a fitting 81A to be in fluid communication with the bore 24. In addition, the conduit 62 is connected to an inlet supply conduit 66. The inlet supply conduit 66 is connected to a fitting 81B which is in fluid communication with the bore 25. A discharge conduit 67 is connected to a fitting 82B. The fitting 82B is in fluid communication with the bore 24. Similarly, a discharge conduit 68 is connected to a fitting 82B. The fitting 82B is in fluid communication with the bore 25. The discharge conduits 67, 68 are connected to a combined discharge conduit 69. The fittings 81A, 81B, 82A and 82B each provide passageways in fluid communication with a one-way valve or check valve (not shown). The one-way valve prevents flow of fluid in a reverse direction from the prescribed flow direction.

A three-way valve 70 is connected to the discharge conduit 69. A conduit 74 connected to the mixing nozzle N is connected to one flow path of the three-way valve 70. In addition, a return conduit 61 is connected to another flow path through the three-way valve 70. A valve member 72 for connecting the discharge conduit 69 to either the conduit 74 or the conduit 71 is disposed within the three-way valve 70.

In operation, the motor 40 imparts reciprocation to the shaft 54. In a first direction, the carriage 30 and thereby the end connector 50A is reciprocated towards the left to discharge fluid within the bore 24 through the discharge conduit 67 and to the three-way valve 70. If the three-way valve is in the "off" position, the valve member 72 recirculates the concentrate through the return conduits 61 and back to the source 60. As the shaft 54 is reciprocated in the first direction, concentrate is supplied through the inlet supply conduit 66, the fitting 81B to the bore 25. A limit switch 93 is operatively disposed adjacent to the end connector 50A. As the shaft 54 is reciprocated to a predetermined position, the plunger 94 activates the limit switch 93 to reverse the direction of the motor 40.

Figure 1B:
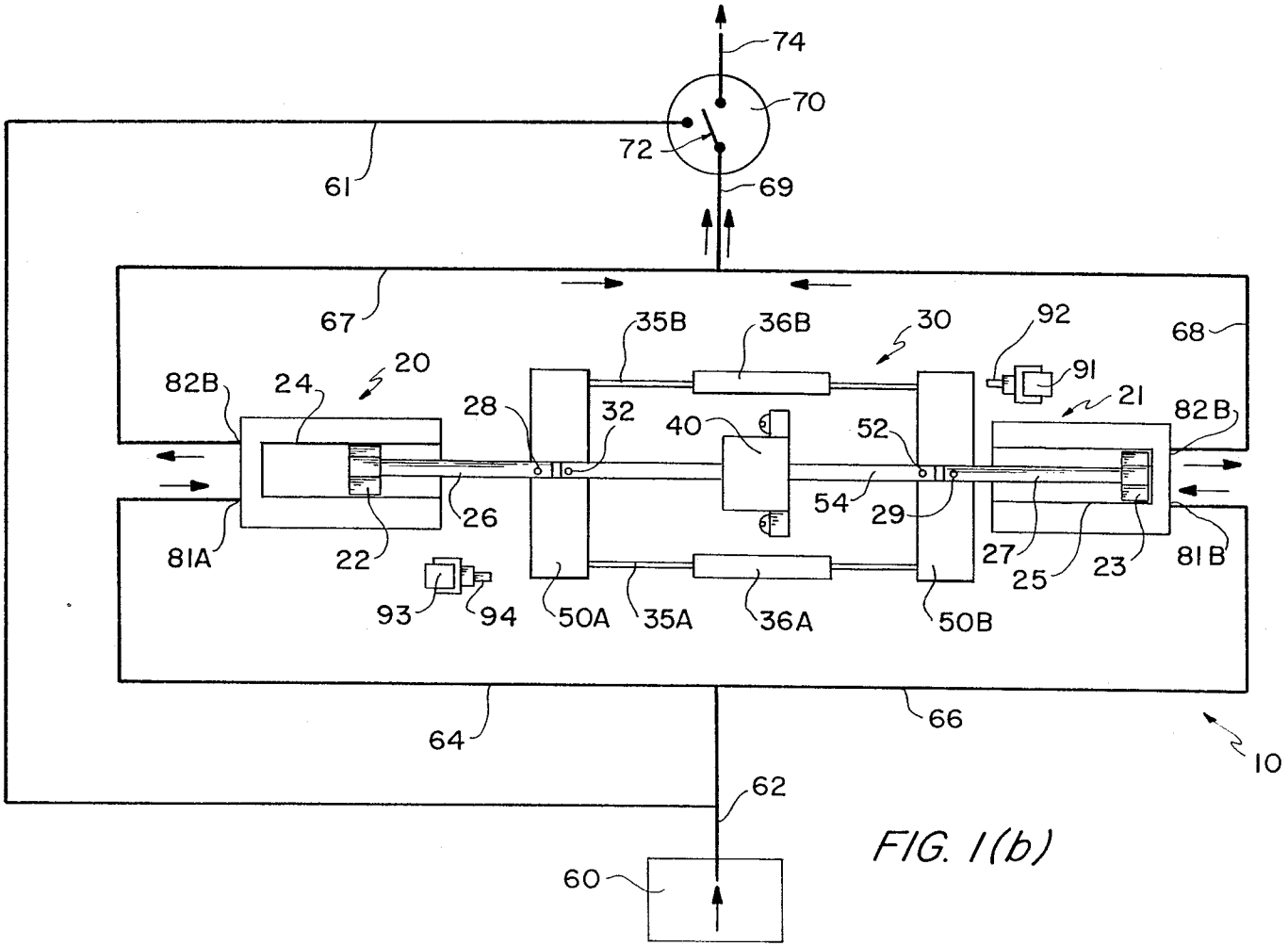

As the motor 40 reverses the direction, the shaft 54 reciprocates the carriage and thereby the end connector 50B in a reverse direction. The piston 23 is moved towards the right as illustrated in FIG. 1(b) to discharge concentrate through the fitting 82B to the discharge conduits 68, 69 to the three-way valve 70. If the three-way valve 70 is in the "off" position, the valve member 72 recirculates the concentrate through the return conduit 61 back to the source 60. A limit switch 91 is operatively mounted adjacent to the end connector 50B. As the end connector 50B engages a plunger 92, the limit switch 91 is actuated to reverse the direction of the motor 40. The motor 40 may be a stepping or synchronous motor manufactured by Hurst Instrument Motors, Princeton, Indiana. See Appendix A.

If the three-way valve 70 is in the "on" position, the concentrate which is dispensed from the bores 24, 25 through the discharge conduits 67, 68, respectively, and to the discharge conduit 69 is supplied to the conduit 74 for dispensing to the nozzle N. In the "on" position, the valve member 72 operatively connects the flow of fluid from the discharge conduit 69 to the conduit 74.

Figure 2A:
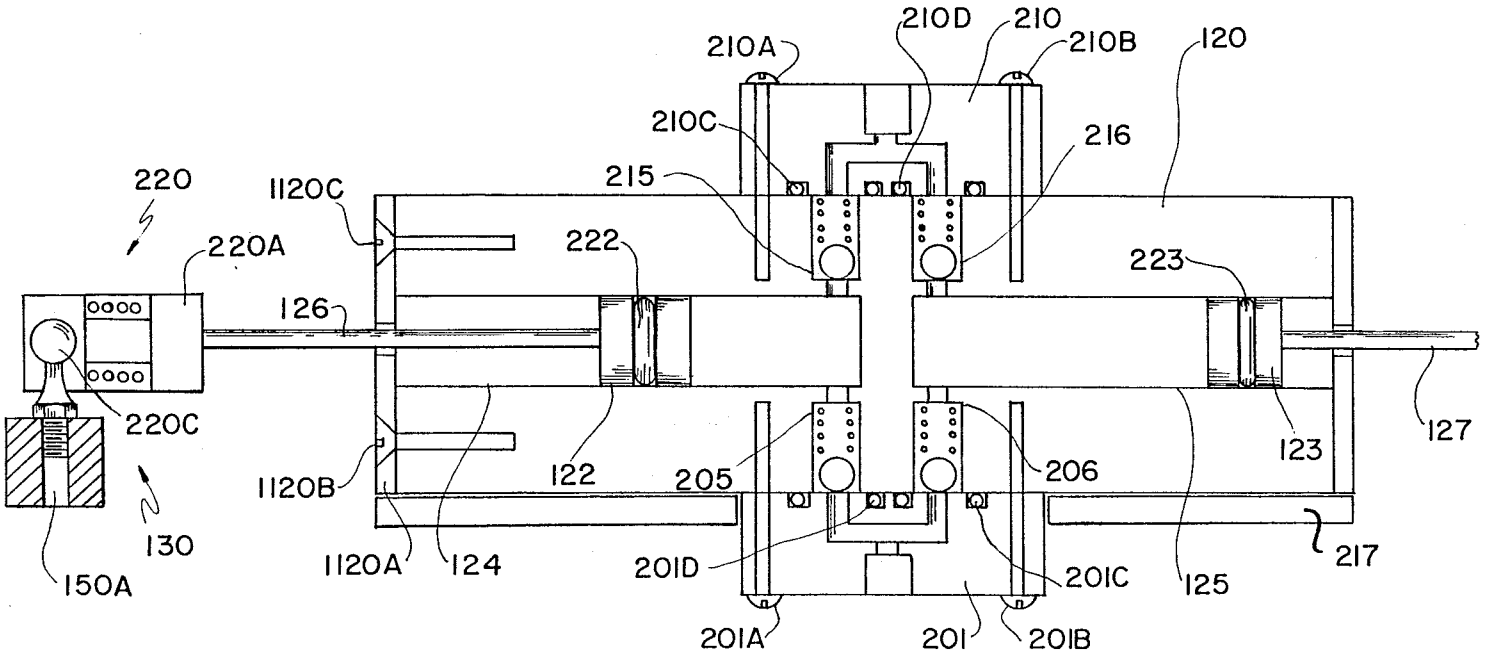
FIG. 2(*a*) is a partial cross-sectional view of a second embodiment of a single channel of the multi-channel linear concentrate pump of the present invention.
Figure 2B:
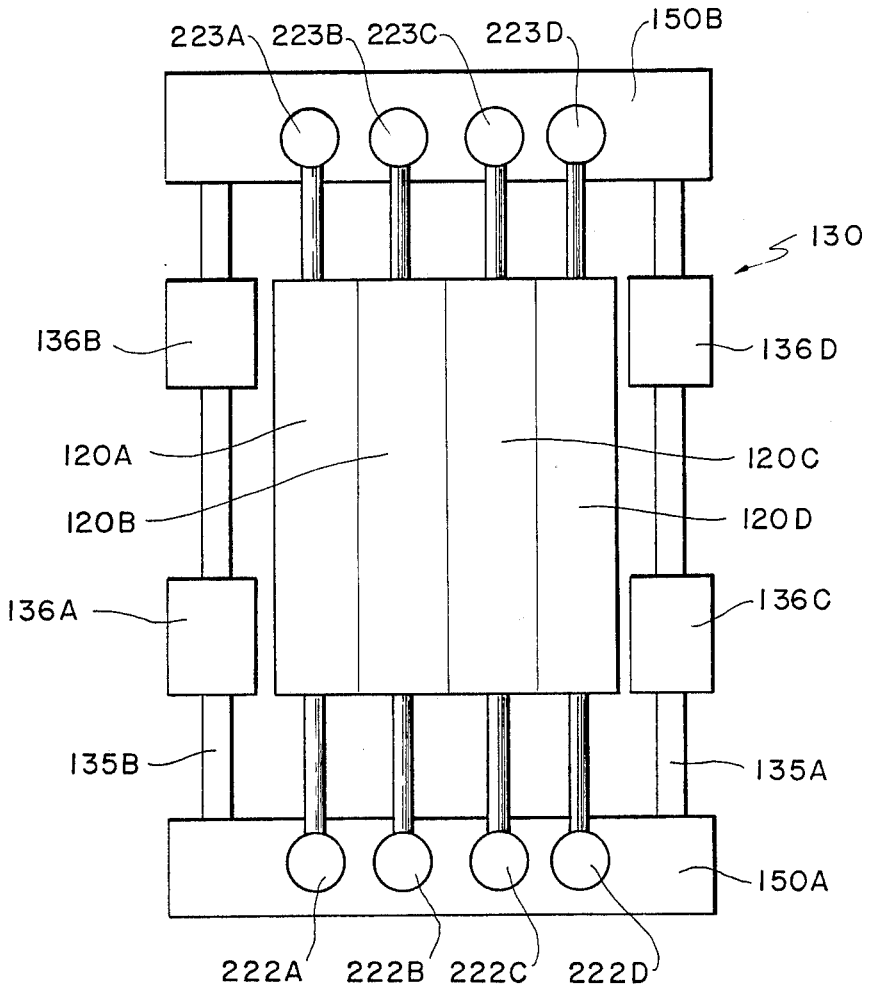

FIGS. 2(*a*) and 2(*b*) illustrate plan and crosssectional views, respectively, of an embodiment of the present invention wherein the pump body 120 is constructed as a single unit. In this embodiment, a piston 122 is operatively mounted for reciprocation within a bore 124. Similarly, a piston 123 is operatively mounted within a bore 125. A piston shaft 126 is secured to a ball joint assembly 220. The ball joint assembly can be of the commercially available "quick release" type to allow for easy disassembly and removal of the pump body. The ball joint assembly 220 includes a housing 220A. In addition, a ball joint 220C is secured to an end connector 150A. The piston 123 is secured to a piston shaft 127. The piston shaft 127 is connected to an end connector of a synchronous motor assembly, not illustrated in FIG. 2(*a*), in a similar manner as the piston shaft 126 is connected to the end connector 150A.

Figure 6:
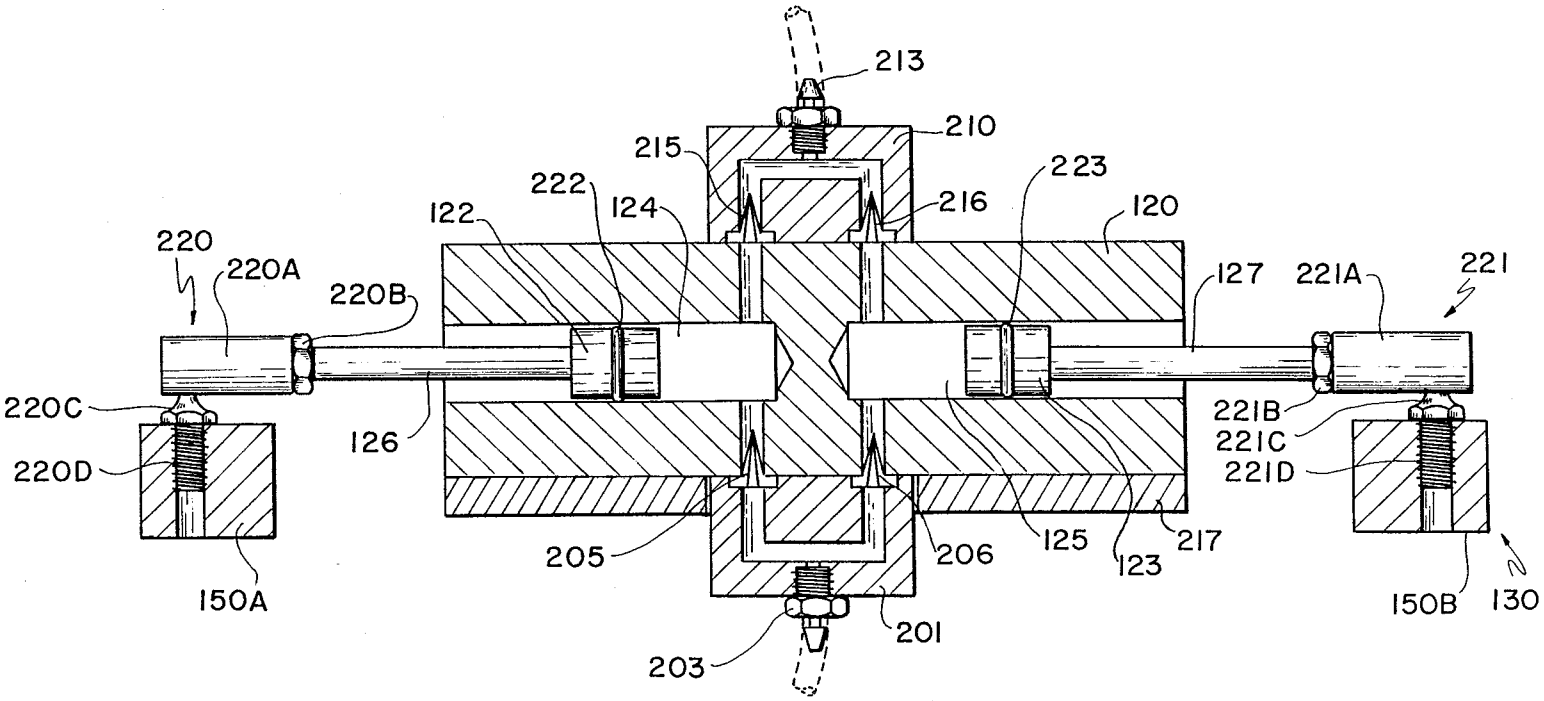
FIG. 6 is a cross-sectional view illustrating the location of the fluid input and output manifolds of a multi-channel linear concentrate pump of FIG. 5.

As illustrated in FIGS. 2(*a*) and 6, a manifold 201 is secured to the pump body 120. The manifold 201 includes a fitting 203. The fitting 203 is operatively connected to an inlet supply conduit for supplying concentrate to either the bore 124 or the bore 125. Check valves 205, 206 of either the "duckbill" type as shown in FIG. 6 or of the "ball" type as shown in FIG. 2(*a*) are disposed within the flow path of the fluid flowing through the manifold 201. The valves 205, 206 are one-way or check valves which only permit the concentrate to flow from the manifold 201 into either the bore 124 or the bore 125. In other words, during reciprocation of the piston 122 in a first direction, the valve 205 would be open to supply concentrate to the bore 124. At the same time, the check valve 206 is closed to prevent concentrate within the bore 125 from communicating back to the manifold 201. As the motor reverses direction and piston 122 moves in an opposite direction, the check valve 205 is closed to prevent the communication of concentrate from the bore 124 to the manifold 201. In the reverse direction of the piston 122, the piston 123 is supplying concentrate to the bore 125 wherein the check valve 206 is open to permit the concentrate within the manifold 201 to be supplied to the bore 125.

A manifold 210 is secured as an outlet manifold to the pump body 120. The manifold 210 includes an outlet fitting 213. The outlet fitting 213 is connected to a discharge conduit for supplying concentrate to the three-way valve 70. A check valve 215 is operatively positioned between the bore 124 and the passageway disposed within the manifold 210. Similarly, a check valve 216 is operatively positioned in fluid communication between the bore 125 and the passageway disposed within the manifold 210. The check valves 215, 216 are one-way valves which function in a similar manner as the check valves 205 and 206. In other words, when the piston 122 is reciprocated towards the right, as illustrated in FIGS. 2(*a*) and 6, fluid is discharged from the bore 124 through the check valve 215 and the outlet fitting 213 to the discharge conduit. In this direction of movement, the check valve 216 is closed. As the piston 123 is reciprocated to the left, as illustrated in FIGS.

2(*a*) and 6, the concentrate within the bore 125 is discharged through the check valve 216 and the manifold 210 to the outlet fitting 213 and the discharge conduit. In this direction of movement of the piston 123, the check valve 215 is closed.

FIGS. 2(*a*) and 6 illustrate a locator plate 217 which is utilized to secure the pump body 120 in a predetermined position relative to the carriage assembly 130. The carriage assembly 130 includes the end connectors 150A, 150B and the guide rods, not illustrated in FIGS. 2(*a*) and 6. A ball joint assembly 220 is connected to the piston shaft 126. The ball joint assembly includes a housing 220A secured by means of a nut 220B to the piston shaft 126. A ball socket is mounted on the stem 220C which is secured by means of threads 220D to the end connector 150A. Similarly, a ball joint assembly 221 is provided which is secured to the piston shaft 127. A housing 221A is affixed by means of a nut 221B to the shaft 127. A stem 221C is secured to a ball joint disposed within the housing 221A. Threads 221D are mounted on the stem 221C for securing the ball joint assembly 221 to the end connector 150B. In addition, an O-ring 222 is secured to the piston 122. Similarly, an O-ring 223 is secured to the piston 123. The O-rings 222 and 223 are utilized to provide a fluid-tight seal between the pistons 122, 123 and the bores 124, 125, respectively.

The pump body 120, as illustrated in FIG. 2(*a*), includes an end plate 1120A. The end plate 1120A is secured to the pump body 120 by means of bolts 1120B, 1120C. In addition, the manifold 201 is secured to the pump body 120 by means of bolts 201A, 201B. In addition, the manifold 210 is secured to the pump body 120 by means of bolts 210A, 210B. An O-ring 201C is disposed between the manifold 201 and the pump body 220. The O-ring 201C provides a fluid-tight seal between the manifold 201 and the pump body 120. In addition, an O-ring 201D is disposed between an interior portion of the manifold 201 and the pump body 120. The O-rings 201C and 201D provide a fluid-tight communication to permit concentrate to flow through the manifold and to the bores 124, 125 during respective reciprocations of the piston 122 and 123.

An O-ring 210C is disposed between the manifold 210 and the pump body 120. In addition, an O-ring 210D is mounted adjacent an interior portion of the manifold 210 and the pump body 120. The O-rings 210C and 210D provide a fluid-tight seal between the manifold 210 and the pump body 120.

FIG. 2(*b*) illustrates diagrammatically the positioning of a plurality of pump bodies 120A, 120B, 120C and 120D which are of the same type as pump body 120 of FIG. 2(*a*) or pump body 120 of FIG. 6, relative to end connectors 150A and 150B. Ball joint assemblies 222A, 222B, 222C and 222D connect respective pump bodies 120A-120D to the end connector 150A. Similarly, ball joint assemblies 223A, 223B, 223C and 223D connect respective pump body assemblies 120A–120D to the end connector 150B. A shaft is connected to the end connector 150B for imparting reciprocation to a carriage 130. The carriage 130 is mounted for reciprocation within the carriage guide blocks 136A, 136B, 136C and 136D.

FIG. 3 illustrates a conventional means of securing a piston shaft 126 to an end connector 150. A set screw 151B secures the piston shaft 126 connected to the piston 122 in a fixed orientation relative to the end connector 150. In addition, rods 135A and 135B are secured to the end connector 150 by means of set screws 151A, 151C, respectively. Thus, the mounting of the piston shaft 126 and the piston 122 is in a fixed orientation relative to the end connector 150. This arrangement is unsatisfactory due to the fact that the piston 122, shaft 126, and end connector 150 must be accurately machined in order for the piston 122 to be disposed directly in the center of the bore in which it is disposed.

FIGS. 4(*a*) and 4(*b*) illustrate the ball joint assembly according to the present invention. Guide rods 35, 36 are secured to an end connector 150'. Screws 35A, 35B affix the rods 35, 36 to the end connector 150'. A ball joint assembly 220 mounts the piston shaft 26 to the end connector 150'. The ball joint assembly 220 includes a stem 220C affixed to the end connector 150' by means of a threaded portion 220D. A ball 220E is secured to the stem 220C. The ball 220E is mounted within a semispherical recess 220F in the housing 220A. In this manner, any inaccuracies in the machining of the end connector can be readily adjusted by the movement of the piston shaft 26 relative to the end connector 150'. Thus, the piston 22 will always be accurately disposed within the bore of the pump body. This piston 22 will seek its own center as it reciprocates within the bore.

Figure 5:
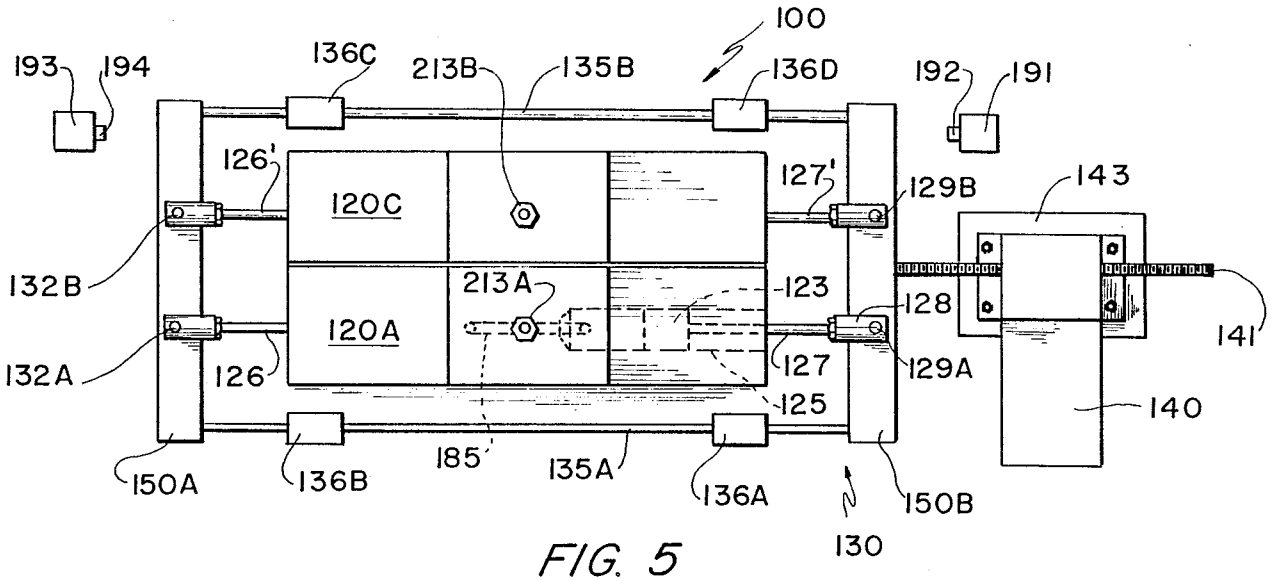
FIG. 5 is a top plan view illustrating two channels of linear pumps in a common carriage to form a multi-channel linear concentrate pump.
Figure 9:
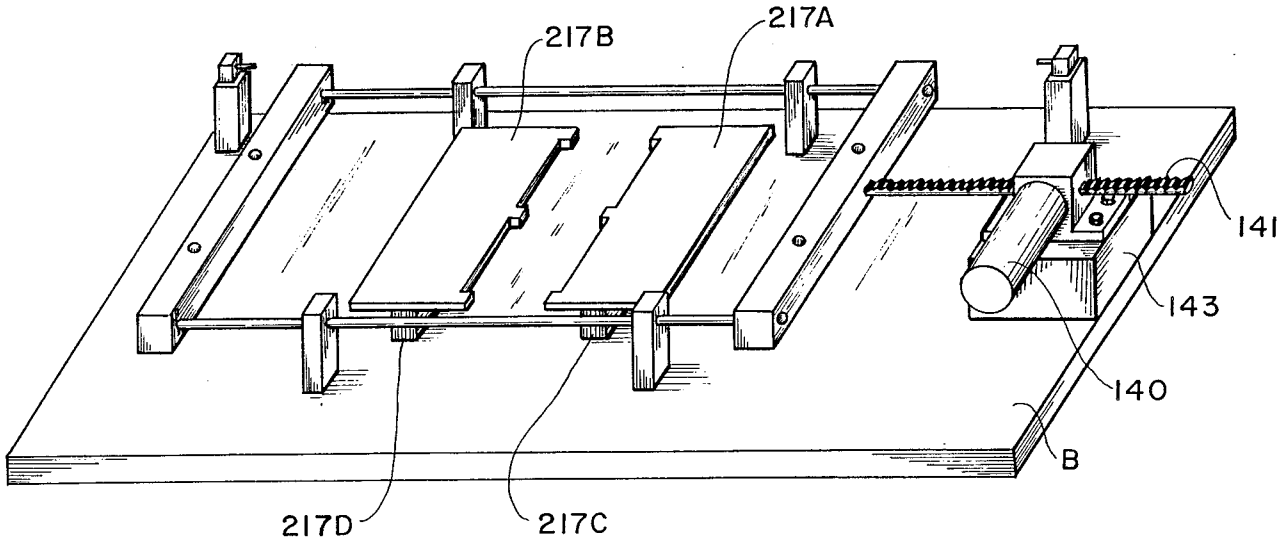
FIG. 9 is a perspective view illustrating a preferred construction of the carriage and end connectors and a multi-pump mounting means in accordance with the present invention.
Figure 13:
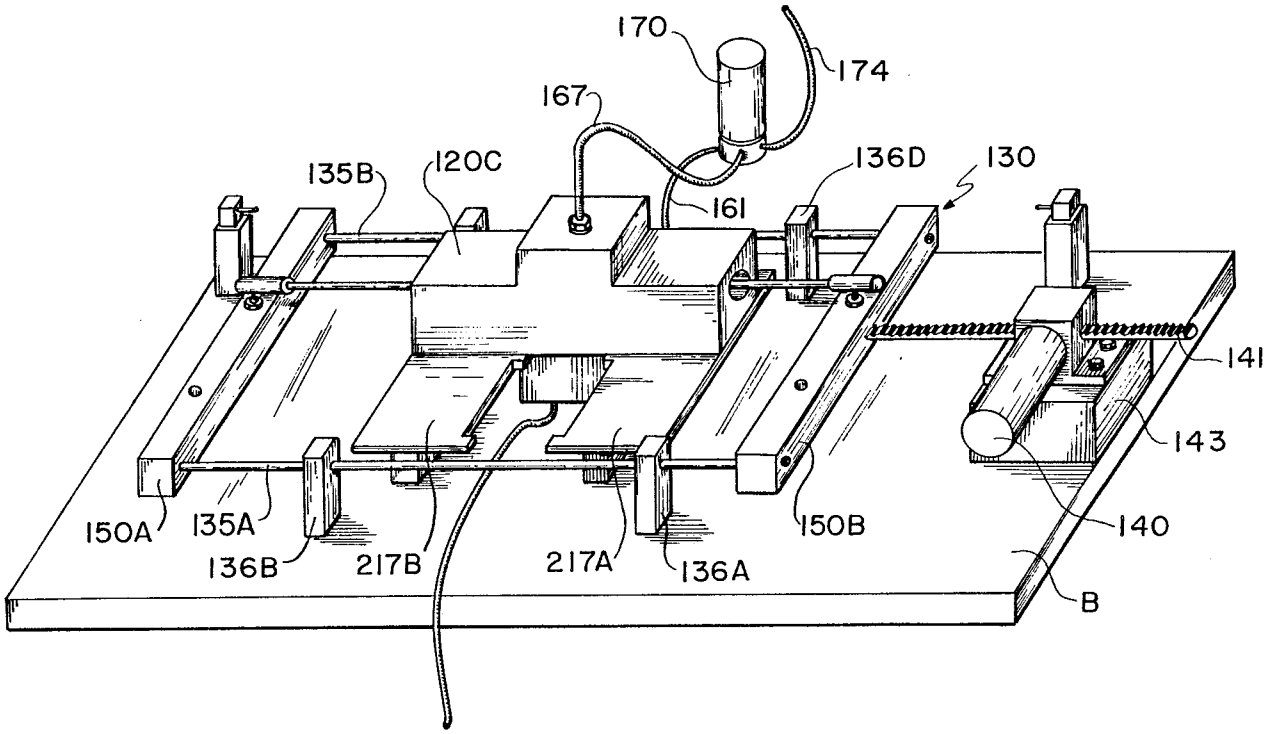
FIG. 13 is a perspective view illustrating the carriage, end connectors and mounting means shown in FIG. 9 and further including one of two pump bodies disposed in the mounting means and connected to the carriage.

FIGS. 5, 9 and 13 illustrate another embodiment of the present invention. In this embodiment, a single synchronous motor 140 is secured to a shaft 141. The motor 140 may be a motor manufactured by Oriental Motor of Torrance, California. See Appendix B. The shaft 141 is a toothed rack. A spacer block 143 is provided to mount the motor 140 relative to the base B. The spacer block mounts the motor at a predetermined distance above the base B in order to properly align shaft 141 with end connector 150B. A carriage assembly 130 includes end connectors 150A, 150B and guide rods 135A, 135B. The guide rod 135A is mounted for reciprocation within the carriage guide blocks 136A, 136B. Similarly, the guide rod 135B is mounted for reciprocal motion within the carriage guide blocks 136C, 136D. The pump bodies 120A and 120C are fixed relative to the motor 140. Thus, as the shaft 141 is reciprocated to cause reciprocation of the carriage 130, the pistons disposed on the piston shafts will reciprocate within the pump bodies 120A, 120C.

The manifold includes a fluid passageway 185 which is connected to the bore 125. Concentrate is supplied to the bore 125 through the passageway 185. A piston 123 is affixed to the piston shaft 127. Similar pistons (not shown) are secured to shafts 126, 126' and 127', respectively. The piston shaft 127 is secured to the end connector 150B by means of a ball joint assembly 128. The ball joint assembly 128 includes a ball joint fitting 129A for permitting movement between the piston shaft 127 and the end connector 150B. Similarly, the piston shaft 127' is secured to the end connector 150B by means of a ball joint 129B. Further, the shafts 126 and 126' are secured to the end connector 150A by means of a ball joint connection 132A, 132B. A limit switch 193 is disposed to be positioned adjacent to the end connector 150A. As the synchronous motor 140 reciprocates the shaft 141, the end connector 150A will engage the plunger 194. This movement will actuate the limit switch 193 to reverse the direction of the motor 140. As the motor 140 operates in the reverse direction, the shaft 141 will move the end connector 150B towards the right as illustrated in FIG. 5. Engagement of the end connector 150B with the plunger 192 will actuate the limit switch 191. Actuation of the limit switch 191 will cause the motor 140 to reverse its direction. As an individual selects a flavor (one of two in FIG. 5) to be dispensed from the system, the three-way valve corresponding to the particular flavor is actuated to be in the "on" position. The other remains in the "off" position. When the user places a cup or other finished drink container into the system, motor 140 is actuated causing the selected flavor concentrate to flow to the nozzle. As the flavor is dispensed through the nozzle N, the sugar/water syrup and carbonated water are simultaneously dispensed thereto. When an individual removes the finished drink container from the system, the motor 140 is deactuated and will not be reactuated until another flavor is selected by an individual. Simultaneously, both three-way valves return to the "off" position.

FIGS. 9 and 13 illustrate a locator plate 217A, 217B for securing the pump body, such as 120A and 120C of FIG. 5, to the base B. The locator plates 217A, 217B are spaced a predetermined distance above the base B by means of spacers 217C, 217D. The spacing of the pump body 120B above the base B permits a manifold to be affixed to supply fluid to the pump body 120B from underneath. FIG. 13 illustrates the pump body 120C secured to the locator plates 217A, 217B. A three-way valve 170 is operatively connected to the pump body 120C. A discharge conduit 167 and a return conduit 161 are secured to the three-way valve 170. A dispensing conduit 174 is connected to supply concentrate from the pump body 120B to the nozzle N.

Figure 7:
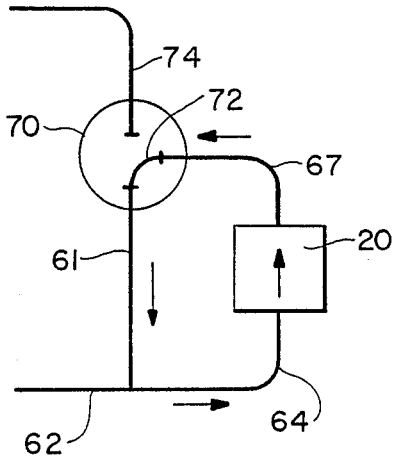
FIG. 7 is a schematic view illustrating the flow of concentrate through a three-way valve in one of the pump channels during recirculation of the concentrate.
Figure 8:
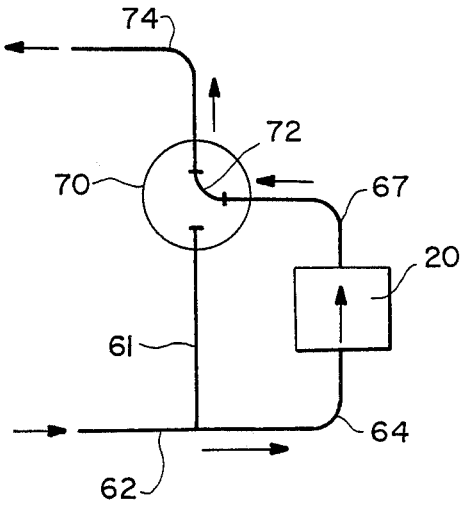
FIG. 8 is a schematic view illustrating flow of concentrate through a three-way valve in one of the pump channels during dispensing of the concentrate.

FIG. 7 illustrates an "off" position of the three-way valve 70. In the "off" position, the valve member 72 connects the conduit 67 to the return conduit 61 for recirculating the concentrate. FIG. 8 illustrates an "on" position of the three-way valve. The valve member 72 connects the conduit 67 to the discharge conduit 74. In this position, concentrate is pumped through the pump body 20 to discharge conduit 74 and to the nozzle N.

Figure 10:
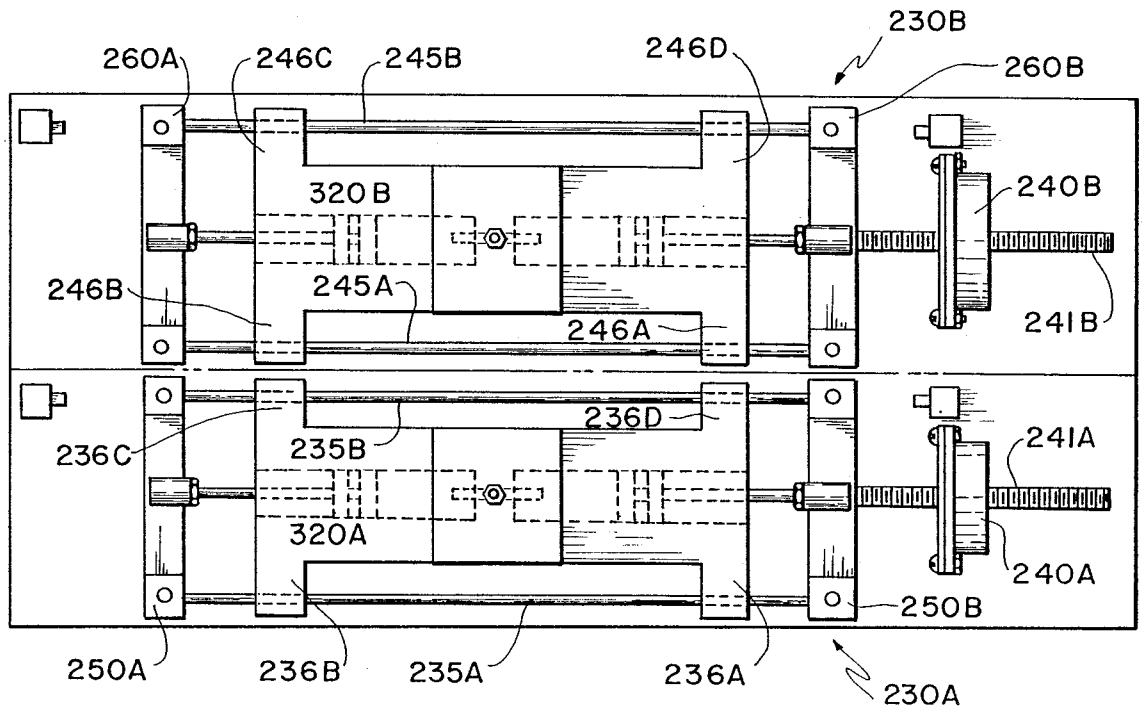
FIG. 10 is a plan view in partial cross section illustrating the construction of another embodiment of the present invention wherein two motors are utilized to individually reciprocate end connectors operatively connected to individual pump bodies in two respective channels of a multi-channel pump.
Figure 11:
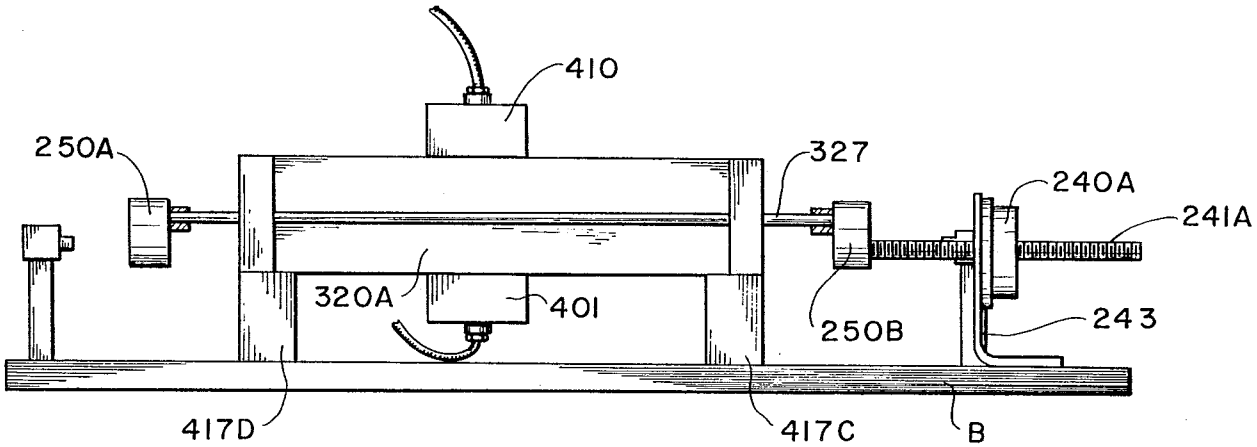
FIG. 11 is a side-elevational view of the multi-channel linear concentrate pump illustrated in FIG. 10.

FIGS. 10 and 11 illustrate another embodiment of the present invention. In this embodiment, individual motors 240A, 240B are operatively connected to individual shafts 241A, 241B. The individual shaft 241A is connected to a carriage 230A. In addition, the shaft 241B is connected to the carriage 230B.

The carriage 230A includes guide rods 235A, 235B. Carriage guide blocks 236A, 236B, 236C and 236D guide the reciprocation of the rods to 235A, 235B as the end connectors 250B, 250A are reciprocated by means of the motor 240A. The carriage guide blocks 236A, 236B are integral members with the pump body 320A.

Similarly, guide rods 245A, 245B are mounted on the end connectors 260A, 260B. Carriage guide blocks 246A, 246B, 246C and 246D guide the movement of the guide rods 245A, 245B. Pump bodies 320A, 320B are fixed relative to the base. The carriages 230A, 230B reciprocate to impart movement to the pistons disposed within the pump bodies 320A, 320B upon selective operation of the motor 240A, 240B.

As illustrated in FIG. 11, the pump body 320A includes an inlet manifold 401 secured to the lower side thereof. An output manifold 410 is connected to an upper portion of the pump body 320A. Spacers 417C, 417D mount the pump body 320A upwardly relative to the base B so as to permit the manifold 401 to supply concentrate to the pump body 320A. A mounting plate 243 secures the motor 240A relative to the base B. In this manner, the shaft 241A is mounted at approximately the same disposition as the piston shaft 327.

The connection of the piston shafts to the end connectors 250A, 250B, 260A, and 260B includes a ball joint assembly. The ball joint assembly permits the pistons disposed within the pump bodies 320A, 320B to be accurately aligned for reciprocation therein.

Figure 12:
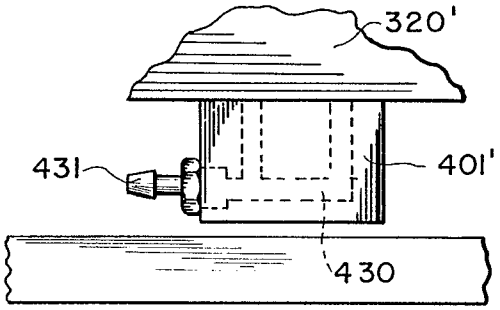
FIG. 12 is a partial enlarged view of an alternative form of an inlet manifold and inlet fitting.

FIG. 12 illustrates an enlarged view of an embodiment of a inlet manifold 401'. The inlet manifold 401' includes a passageway 430 disposed therein. An inlet fitting 431 is connected to the passageway 430. One-way valves are disposed relative to the passageway 430 to permit only a supply of concentrate to the pump body 320'.

Figure 14:
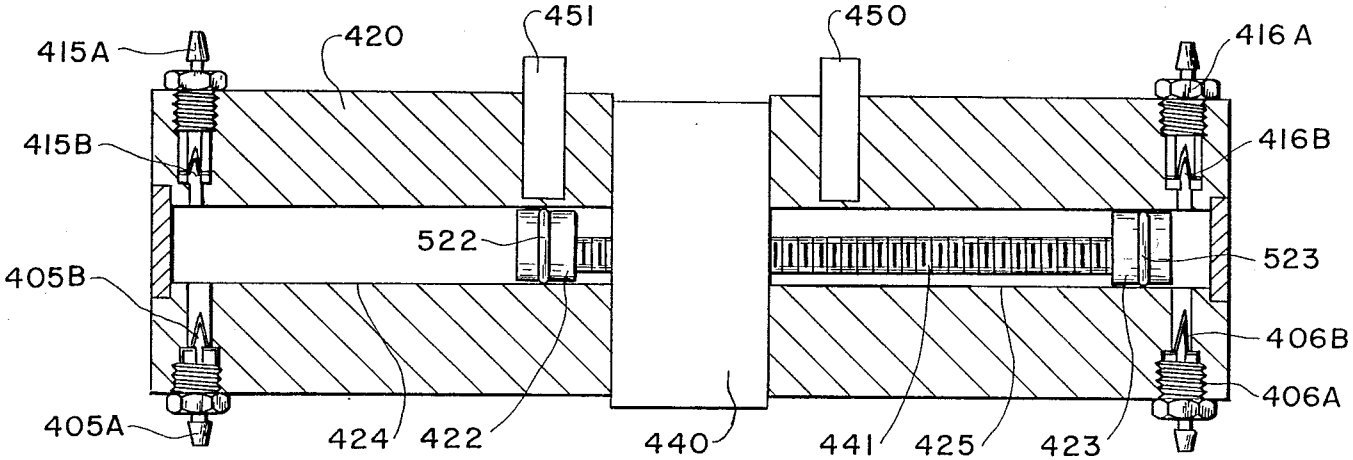
FIG. 14 is a cross-sectional view illustrating another embodiment of the present invention wherein the motor is disposed centrally within the pump body and coupled to a shaft having a piston at each distal end thereof.

FIG. 14 illustrates another embodiment of the present invention. A single synchronous motor 440 is centrally mounted relative to a pump body 420. A piston 422 is affixed to one end of a shaft 441. A piston 423 is affixed to the other end of the shaft 441. The piston 422 is mounted for reciprocation within the bore 424. Similarly, the piston 423 is mounted for reciprocation within the bore 425.

Concentrate is supplied to the bore 424 through an inlet fitting 405A and a one-way duckbill check valve 405B. Concentrate is discharged from the bore 424 through a one-way duckbill check valve 415B and an outlet fitting 415A. Similarly, concentrate is supplied to the bore 425 through an inlet fitting 406A and a one-way duckbill check valve 406B. Concentrate is discharged from the bore 425 through the outlet fitting 416A and a one-way duckbill check valve 416B. An O-ring 523 is mounted on the piston 423. In addition, an O-ring 522 is mounted on the piston 422. The O-rings 522 and 523 produce a fluid-tight seal within the bores 424, 425 of the pump body 420.

The motor 440 reciprocates the shaft 441 within the bores 424 and 425. Metal sensors 450, 451 detect the positioning of the pistons 422, 423 relative to the motor 440 to reverse the direction of rotation of the motor. Shaft 441 is mounted slightly off center with respect to the bores 424 and 425 to prevent the shaft and pistons from rotating during reciprocation.

Figure 15:
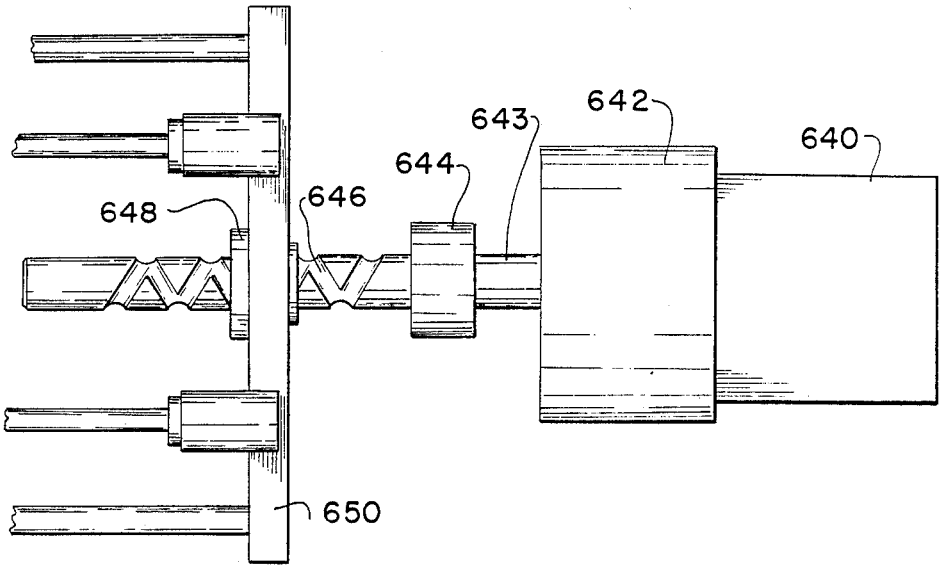
FIG. 15 is a partial enlarged view of an alternative form of a drive connection utilizing a gear head, coupler and ball reverser.

FIG. 15 is a partially enlarged view of an alternative form of a drive connection wherein a synchronous A.C. motor 640 is connected to a rotary gear head 642. The direction of rotation of the synchronous A.C. motor 640 is always in the same direction. This embodiment is different from previous embodiments of the present invention wherein the rotation of the synchronous A.C. motor must be reversed in direction in order to pump fluid from the multi-channel linear concentrate pump. The gear head 642 is connected to a coupler 644 by means of a shaft 643. A ball reverser 646 is connected to the coupler 644. The gear head 642 is a rotary gear head for imparting constant rotation to the shaft 643 and the coupler 644. The ball reverser 646 is rotated within a sleeve 648 mounted on the carriage 650. The specific construction of the ball reverser 646 may be similar to a NORCO Ball Reverser set forth in the attached catalog identified as Appendix C. This construction permits an instant turnaround and eliminates the need for limit switches to reverse the direction of the motor as is necessary in previous embodiments of the present invention.

Figure 16:
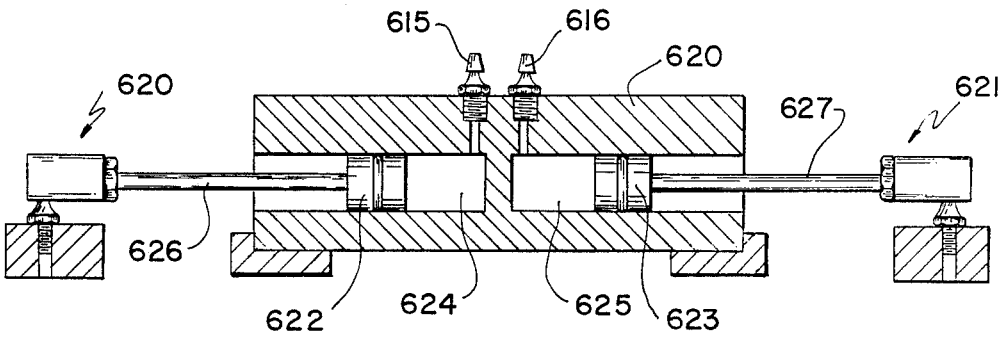
FIG. 16 is a partial cross-sectional view of another embodiment of a single channel of the multi-channel linear concentrate pump for use together with in-line check valves.

FIG. 16 is a partial cross-sectional view of another embodiment of the present invention wherein a pump body 620 is illustrated to include a bore 624 in which a piston 622 is mounted for reciprocation. The piston 622 is connected to a shaft 626 which is affixed to a ball joint assembly 620. Similarly, a bore 625 includes a piston 623 mounted for reciprocation therein. A piston shaft 627 is operatively connected to the piston 623 and to a ball joint assembly 621. The check valves are not mounted within the pump body as set forth in previous embodiments of the present invention. The fittings 616 and 615 are in fluid communication with the bores 624 and 625. The fittings 615, 616 are connected with in-line check valves which will be further identified with reference to FIG. 17.

Figure 17:
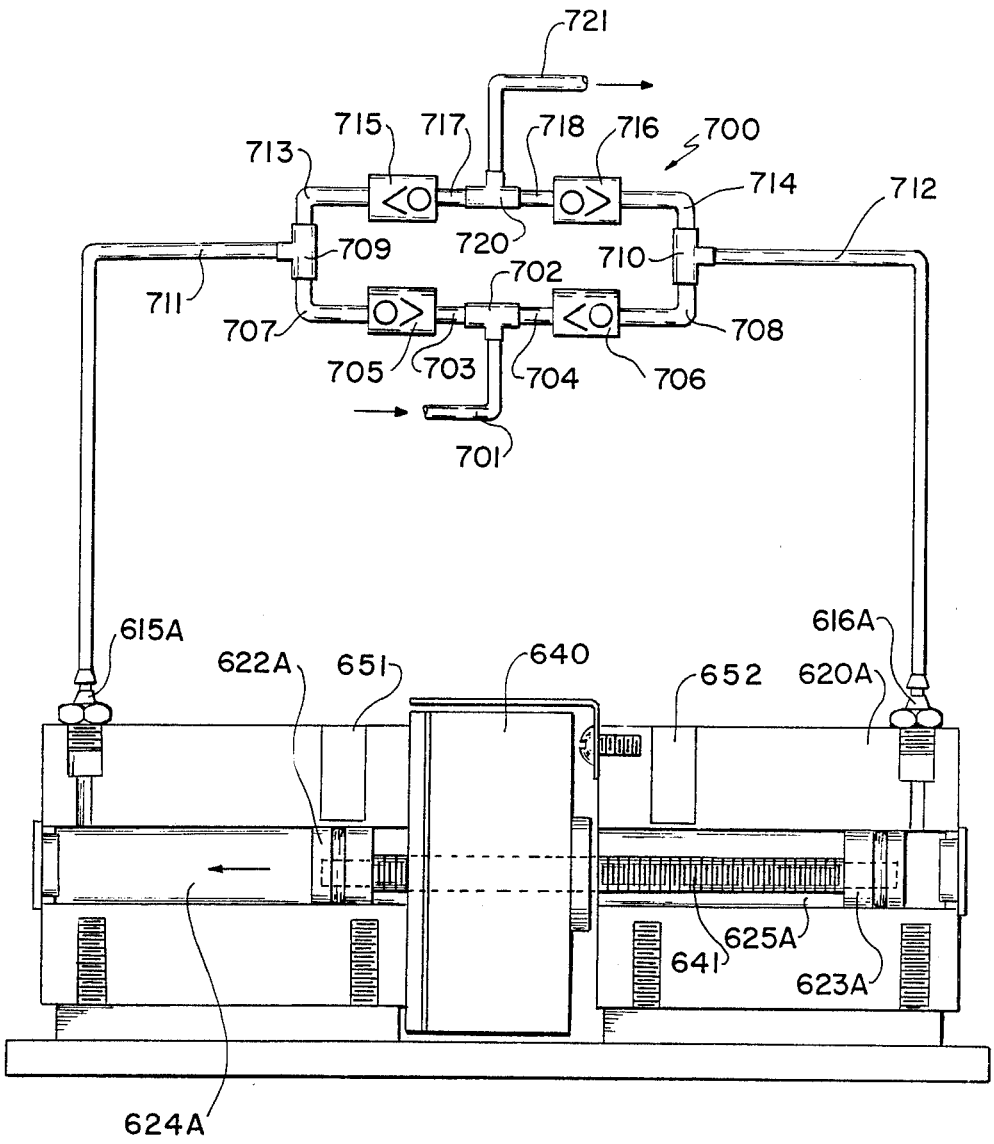
FIG. 17 is a partial cross-sectional and schematic view illustrating a centrally disposed motor in a single channel of the multi-channel linear concentrate pump connected with in-line check valves.

FIG. 17 is a partial cross-sectional and schematic view illustrating a centrally disposed linear stepping motor 640. The linear stepping motor 640 may be utilized instead of a synchronous linear motor as set forth in previous embodiments of the present invention. The linear stepping motor 640 would permit the speed of the pump to be adjusted, thereby adjusting the flow rate. Further, the stepping motor 640 could be controlled by an appropriate microprocessor base device using input from a flow sensor on the water side of the system.

A pump body 620A includes a bore 625A in which a piston 623A is mounted for reciprocation. The piston 623A is affixed to a shaft 641. Similarly, a bore 624A is provided wherein a piston 622A is operatively mounted for reciprocation. The piston 622A is affixed to the shaft 641. The shaft 641 is off-center slightly with respect to the center of the bore. In this manner, as the drive nut inside the motor 640 rotates, the pistons 623A and 624A reciprocate within the bore and are prevented from rotating.

The fittings 615A and 616A are in fluid communication with the bores 624A and 625A, respectively. Metal sensors 651, 652 detect the positioning of the pistons 622A, 623A, respectively. As the pistons 622A, 623A move relative to the motor 640, the sensors 651, 652 reverse the direction of the motor.

An in-line check valve system 700 is provided. Inlet conduit 701 is connected to coupling 702. Coupling 702 diverts the flow of fluid to either the conduit 703 or 704. A one-way check valve 705 is in fluid communication with the conduit 703. Similarly, a check valve 706 is in fluid communication with the conduit 704. A conduit 707 is connected to a coupling 709. Conduit 711 is connected to the coupling 709 and to the fitting 615A. A conduit 713 is connected to the coupling 709 and a one-way check valve 715.

One-way check valve 706 is connected to a conduit 708 which is connected to a coupling 710. A conduit 712 is connected to the coupling 710 and to the fitting 616A. A conduit 714 is connected to the coupling 710 and to a one-way check valve 716. The check valve 716 is connected to a conduit 718 which is connected to a coupling 720. Similarly, the check valve 715 is connected to a conduit 717 which is connected to the coupling 720. An outlet conduit 721 is connected to the coupling 720.

Referring to FIG. 17, the following operation of the in-line check valve 700 will be explained. Assuming the piston 622A is reciprocated to move towards the left in FIG. 17, fluid flowing through conduit 701 will flow through the coupling 702, the conduit 704, the one-way check valve 706, the conduit 708, the coupling 710, the conduit 712 to the fitting 616A and into the bore 625A. Fluid within the bore 624A is discharged through the fitting 615A, the conduit 711, the coupling 709, the conduit 713, the one-way check valve 715, the conduit 717, the coupling 720, and to the outlet conduit 721. The pressure of the fluid within the bore 624A, as it exits through the system, will place a pressure on the one-way check valve 705 to close the check valve. Similarly, pressure will be exerted on the check valve 716 to close the check valve. In this way, the fluid will be permitted to exit from the system while fluid is supplied to the bore 625A.

Reviewing FIG. 17, if we assume that the piston 623A is moving towards the right, fluid will be in the process of being discharged from the bore 625A through the fitting 616A, the conduit 712, the coupling 710, the conduit 714, the one-way check valve 716, the conduit 718, the coupling 720 to the outlet conduit 721. The pressure of fluid exiting from the system will apply a pressure to the one-way check valve 706 to close the check valve. During the exit of the fluid from the bore 625A, fluid is being supplied to the bore 624A. Fluid flows into the conduit 701, the coupling 702, the conduit 703, the one-way check valve 705, the conduit 707, the coupling 709, the conduit 711, the fitting 615A to the bore 624A. The one-way check valve 715 is closed by the pressure of the fluid exiting from the bore 625 through the various conduits to apply a back pressure on the one-way check valve 715.

Figure 18:
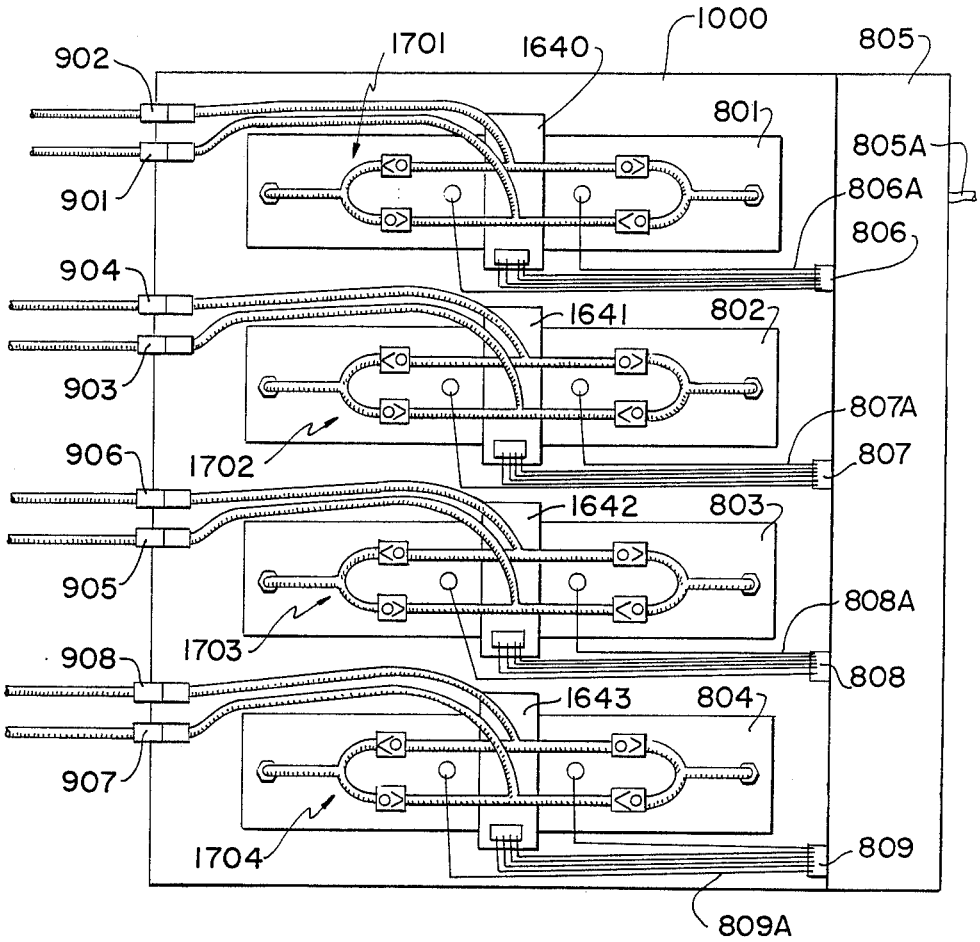
FIG. 18 is a schematic view illustrating a plurality of single channel pump bodies disposed side-by-side to form a multi-channel linear concentrate pump according to the present invention.

FIG. 18 is a schematic view illustrating four mechanically independent one-channel linear pumps 801, 802, 803 and 804 which are arranged side-by-side. An electical supply housing 805 is mounted adjacent to the linear pumps 801–804. Electrical quick disconnects 806, 807, 808 and 809 are provided for connecting the electrical cables 806A, 807A, 808A and 809A which are operatively connected to the linear pumps 801, 802, 803 and 804, respectively. Motors 1640, 1641, 1642 and 1643 are operatively connected with a respective linear pump 801, 802, 803 and 804. The motors 1640–1643 may be either synchronous or stepping type motors. If the motors 1640–1643 are stepping motors, the motor speed and thereby the flow rate can be controlled by the electronics. If the motors 1640–1643 are synchronous, the motor speed, and therefore, the flow rate is constant. Stepping motors permit a ratio adjustment by adjusting the fluid flow rate.

An in-line check valve arrangement 1701, 1702, 1703 and 1704 are operatively connected to respective linear pumps 801, 802, 803 and 804. Quick disconnect fluid couplings 901, 902, 903, 904, 905, 906, 907 and 908 are provided for operatively connecting the inlet and outlet conduits to each of the in-line check valves 1701–1704. The system disclosed in FIG. 18 is similar to the arrangement illustrated and discussed with respect to the FIG. 17.

FIG. 18 provides an illustration of an expedient manner in which to position a plurality of linear pumps 801–804 in a side-by-side arrangement. The electronics 805 are used in conjunction with four product selection switches to determine which of the linear pumps 801–804 should be operated at a particular point in time. The mechanical parts of the pump channels can be easily removed by disconnecting the fluid and the electrical quick disconnects and lifting the pump bodies 801–804 out of the cabinet 1000. The electronic panel 805 is supplied with input and electricity by means of the cable 805A.

OPERATION OF THE PREFERRED EMBODIMENTS

In operation, an individual would select one of a plurality of flavors 1, 2 or 3. Upon selecting a flavor, the multi-channel linear pump is operated to discharge the selected concentrate through a three-way valve. The other concentrates which are not selected, are merely recirculated and are not supplied to the mixing nozzle N. As the predetermined flavor is discharged to the mixing nozzle N, the sugar/water syrup and carbonated water are supplied to the mixing nozzle in the proper proportions and are dispensed into the finished drink cup. As the individual removes the finished drink cup from the unit, the motor is deactuated to stop further movement of the pistons disposed within the multichannel linear pump.

In one embodiment of the present invention, as illustrated in FIGS. 10, 11, 14, 17 and 18, individual motors such as 240A, 240B (FIG. 10) or 440 (FIG. 14) may be directly connected to the flavor selection actuator. In this embodiment, as an individual selects a predetermined flavor, only one of the motors will be actuated to dispense a predetermine quantity of concentrate to the mixing nozzle. As the concentrate is supplied to the mixing nozzle, sugar/water syrup and carbonated water are supplied thereto and mixed to form the finished drink. As the finished drink cup is removed from the system, the individual motor is deactuated to stop further dispensing of the concentrate.

The limit switches according to the present invention may be utilized to stop actuation of the motor when the carriage has been displaced to actuate the limit switch. In this embodiment, the motor would be actuated for a predetermined time to dispense the necessary quantity of flavor concentrate to the mixing nozzle N.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A concentrate supply system for transporting concentrate to the mixing nozzle of a post-mix beverage dispenser comprising:

(a) plurality of containers for concentrate having discharge openings through which concentrate may flow;

(b) a corresponding plurality of linear pumps, one linear pump being operatively associated with each of said containers by having an inlet thereof in fluid communication with the discharge opening of the associated container;

(c) motor means for driving each respective linear pump to pump concentrate from said containers through the pump at a constant rate of flow;

(d) valve means connected to an outlet of each linear pump, said valve means having a first position in which concentrate from the associated outlet passes therethrough to said mixing nozzle and a second position in which said concentrate is recirculated by way of a conduit directly connected to the inlet of the associated pump; and (e) selector means for placing a selected one of said valve means in said first position and the other of said valve means in said second position, (f) wherein each linear pump includes a pump body and at least two bores therein with a piston in each bore, each piston being connected to a shaft extending from opposite ends of said pump body and adapted for linear reciprocating motion imparted by said motor means, said linear pumps being disposed side-by-side with the shafts extending in parallel from the respective ends of said pump bodies;

(g) an end connector bar coupled at each end of said pump bodies to the respective shafts extending therefrom by respective ball joint means for enabling accurate positioning of said pistons connected to said piston shafts with said bores, said end connector bars being driven by said motor means to impart said reciprocating motion to said shafts, whereby a selected one of the concentrates in the container associated with the valve means in said first position is pumped to said mixing nozzle.

2. The concentrate supply system of claim 1, wherein said motor means includes one A.C. synchronous motor, said end connecting bars being coupled together by spaced parallel guide bars to cause simultaneous reciprocating motion of said guide bars.

3. The concentrate supply system of claim 1, and further including a rotary gear head operatively connected to said motor means, a ball reverser operatively connected to said rotary gear head and to one of said end connecting bars, wherein rotation of said motor means, said rotary gear head and said ball reverser imparts reciprocation to said end connecting bars in a first direction and said ball reverser instantly reverses the direction of movement of said connecting bar with continued rotation of said motor means, said rotary gear head and said ball reverser.

4. The concentrate supply system of claim 1, wherein said motor means is an A.C. synchronous motor.

5. A concentrate supply assembly for a post-mix beverage dispenser comprising:

(a) at least two concentrate containers each having a discharge opening through which concentrate flows;

(b) a first conduit coupled to the discharge opening of a first container;

(c) a first linear pump having a first pump body, first and second bores being disposed within said first pump body, first and second pistons operatively mounted within said first and second bores, respectively, for reciprocation, a first piston shaft connected to said first piston, a second piston shaft connected to said second piston, motor means connected to said first and second piston shafts for imparting reciprocating motion to said piston shafts and to said pistons disposed within said bores, a first inlet port in fluid communication with said first conduit and said first bore for supplying concentrate thereto during a reciprocating motion of a first piston in a first direction, a first outlet port in fluid communication with said second bore for discharging concentrate from said second bore during a reciprocating motion of said second piston in said first direction, a second inlet port in fluid communication with said first conduit and said second bore for supplying concentrate thereto during a reciprocating motion of said second piston in a reverse direction, a second outlet port in fluid communication with said first bore for discharging concentrate from said first bore during a reciprocating motion of said first piston in said reverse direction;

(d) a first three-way valve associated with said first linear pump having a valve inlet port and first and second valve outlet ports, the valve inlet port being in fluid communication with said first and second outlet ports, the first valve outlet port being coupled to a recirculation conduit which is coupled in fluid communication with the first conduit and the second valve outlet port being coupled to an outlet conduit extending to a mixing assembly of the dispenser, said first three-way valve having a valve member movable between first and second positions for selectively connecting the valve inlet port with either the first or the second valve outlet ports; and (e) a second conduit coupled to the discharge opening of a second container (f) a second linear pump having a second pump body, a third and fourth bore being disposed within said second pump body, third and fourth pistons operatively mounted within said third and fourth bores, respectively, for reciprocation, a third piston shaft connected to said third piston, a fourth piston shaft connected to said fourth piston, said motor operatively connected to said first linear pump being connected to said third and fourth piston shafts of said second linear pump for imparting reciprocating motion to said piston shafts and to said pistons disposed within said bores, a third inlet port in fluid communication with said second conduit and said third bore for supplying concentrate thereto during a reciprocating motion of said third piston in a first direction, a third outlet port in fluid communication with said fourth bore for discharging concentrate from said fourth bore during a reciprocating motion of said fourth piston in said first direction, a fourth inlet port in fluid communication with said second conduit and said fourth bore for supplying concentrate thereto during a reciprocating motion of said fourth piston in a reverse direction, a fourth outlet port in fluid communication with said third bore for discharging concentrate from said third bore during a reciprocating motion of said third piston in said reverse direction;

(g) carriage means operatively connected to the piston shafts of said first and second linear pumps, said carriage means including guide rods for guiding the reciprocal motion of said carriage and end connectors connected to said guide rods, said piston shafts of said first and second linear pumps being connected to said end connectors of said carriage means by ball joint connections for enabling accurate positioning of said pistons connected to said piston shafts within said bores;

(h) a second three-way valve associated with said second linear pump having a valve inlet port and first and second valve outlet ports, the valve inlet port being in fluid communication with said third and fourth outlet ports, the first valve outlet port being coupled to a recirculation conduit in fluid communication with the second conduit and the second valve outlet port being coupled to an outlet conduit extending to a mixing assembly of the dispenser, said second three-way valve having a valve member movable between first and second positions for selectively connecting the valve inlet port with either the first or the second valve outlet ports; and (i) selector switch means associated with said first and second three-way valves for actuating said valves to move said valve members between the respective first and second positions.

* * * * *